United States Patent [19]

Davitt

[11] 3,963,599

[45] June 15, 1976

[54] RECOVERY OF BITUMEN FROM AQUEOUS STREAMS VIA SUPERATMOSPHERIC PRESSURE AERATION

[75] Inventor: H. James Davitt, Edmonton, Canada

[73] Assignee: Sun Oil Company of Pennsylvania, Philadelphia, Pa.

[22] Filed: Nov. 11, 1974

[21] Appl. No.: 522,379

[52] U.S. Cl. ..... 208/11 LE

[51] Int. Cl.[2] ..... C10G 1/04

[58] Field of Search ..... 208/11; 210/44, 221 P

[56] References Cited

UNITED STATES PATENTS

| | | | |
|---|---|---|---|
| 3,131,141 | 4/1964 | West | 208/11 LE |
| 3,203,888 | 8/1965 | Butler et al. | 208/11 LE |
| 3,448,044 | 6/1969 | Garrett | 210/44 |
| 3,502,565 | 3/1970 | Baillie | 208/11 LE |
| 3,509,037 | 4/1970 | Tse | 208/11 LE |
| 3,542,675 | 11/1970 | Mail et al. | 210/221 P |
| 3,574,086 | 4/1971 | Hyndman | 208/11 LE |
| 3,594,306 | 7/1971 | Dobson | 208/11 LE |

*Primary Examiner*—Delbert E. Gantz
*Assistant Examiner*—James W. Hellwege
*Attorney, Agent, or Firm*—J. Edward Hess; Donald R. Johnson; Richard P. Maloney

[57] ABSTRACT

A method for recovering bitumen from an aqueous stream containing bitumen and mineral matter comprising aerating said stream at a pressure greater than atmospheric and thereafter settling said aerated stream at a lower pressure.

20 Claims, 1 Drawing Figure

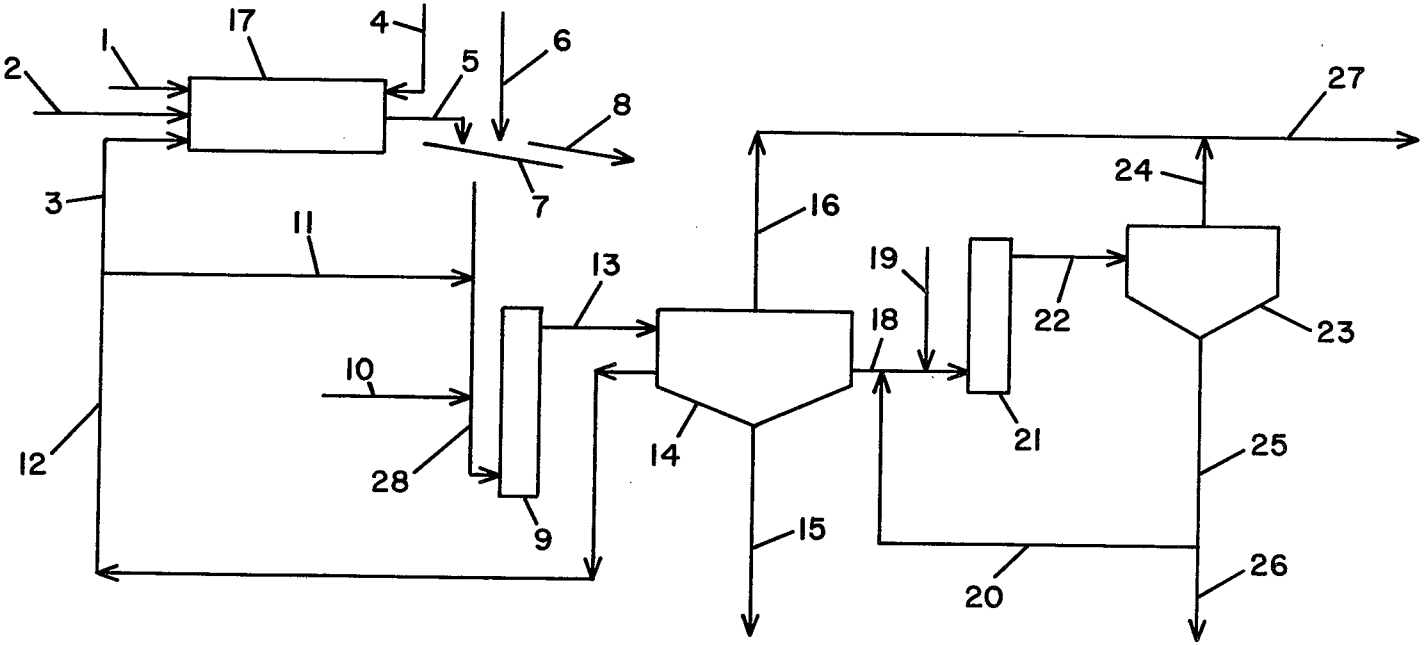
1
2
3
4
5
6
7
8
9
10
11
12
13
14
15
16
17
18
19
20
21
22
23
24
25
26
27
28

RECOVERY OF BITUMEN FROM AQUEOUS STREAMS VIA SUPERATMOSPHERIC PRESSURE AERATION

BACKGROUND OF THE INVENTION

The present invention is a method for recovering bitumen from aqueous streams containing bitumen and mineral matter. In one aspect the present invention is an improvement in the hot water process for extracting bitumen from tar sands. Specifically, the present invention is a method whereby bitumen can be recovered from aqueous streams such as tar sands pulp, effluent discharge streams from a hot water process for extracting bitumen from tar sands or retention pond water associated with tar sands processing.

Tar sands, which are also known as oil sands and bituminous sands, are impregnated with a heavy petroleum. The largest and most important deposits of the sands are those found in northern Alberta, Canada, known as the Athabasca sands. The Athabasca sands are primarily silica, having closely associated therewith an oil film which varies from about 5 percent to 21 percent by weight, with a typical content of 13 weight percent of the sand. The bitumen is quite viscous—6° to 8° API gravity— and contains about 4.5 percent sulfur and about 38 percent aromatics.

The sands contain in addition to the oil and sand components, clay and silt in quantities of from 1 to 50 weight percent, more usually 10 to 30 percent. The sands also contain a small amount of water, in quantities of 1 to 10 percent by weight, in the form of a film around the sand grains.

Several basic extraction methods have been known for years for recovering oil from these sands. The most widely known procedure is the hot water extraction method disclosed in Canadian Patent No. 841,581 issued May 12, 1970, to James Van Dyck Fear et al.

Other proposed methods for recovering bitumen from tar sands include the so called "cold water" method, which involves mixing tar sands with a solvent capable of dissolving the bitumen constituent. The mixture is then introduced into a large volume of water containing a surface agent or an inorganic salt capable of acting as an electrolyte. The combined mass is then subjected to a pressure or gravity separation.

U.S. Pat. No. 2,965,557 issued Dec. 20, 1960 to W.H. Price discloses a method for recovering bitumen from tar sands which comprises mixing the sand with a hydrocarbon diluent and thereafter introducing gas into the sand-diluent mixture to effect separation of the bitumen from the sand prior to settling the sand in an aqueous settling zone.

U.S. Pat. No. 3,203,888 issued Aug. 31, 1965 to R.M. Butler et al. proposes a method for recovering bitumen from tar sands wherein a mixture of tar sands and water is blended with liquified hydrocarbon gas at a pressure sufficient to maintain the gas in a liquid state. The gas-water-tar sands mixture is thereafter agitated and then settled at a lower pressure whereby the added liquid hydrocarbon vaporizes to aid in flotation of bitumen. A critical element of this invention is the solubility of the added liquid hydrocarbon in the bitumen tar sands to provide effective separation of the bitumen constituent from the sand particles.

U.S. Pat. No. 3,573,195 issued Mar. 30, 1971 to C.W. Bowman et al. discloses a method for recovering bitumen from tar sands whereby a liquid hydrocarbon is added to an aqueous slurry of tar sands at a temperature of less than 110°F. Thereafter the mixture is settled in a settling zone maintained above 150°F. An essential element of this invention is that the added liquid hydrocarbon boils above 110°F. so that when the mixture is heated, e.g., to 150°F., the hydrocarbon vaporizes to aid in the flotation of the bitumen in the mixture.

U.S. Pat. No. 3,574,086 issued Apr. 6, 1971 to A.W. Hyndman proposes a method for recovering bitumen from tar sands wherein an aqueous slurry of tar sands is formed in an atmosphere of a gaseous hydrocarbon so that the gas is entrained in the slurry and subsequently aids in flotation of the bitumen component of that slurry in a settling procedure which follows.

Canadian Pat. No. 882,666 issued Oct. 5, 1971 to Harold F. Tse proposes forming a mixture of tar sands, water, solvent (boiling at a higher temperature than water) at a temperature in the range of 220° to 325°F. and a pressure between 16 and 100 psig; passing the mixture to a zone having temperature and pressure conditions to provide that at least a part of the water vaporizes as steam to aid flotation of froth; and subsequently recovering bitumen froth.

In the hot water method, as disclosed in Canadian Pat. No. 841,581 issued May 12, 1970, the bituminous sands are jetted with steam and mulled with a minor amount of hot water at temperatures of 170° to 190°F., and the resulting pulp is then dropped into a turbulent stream of circluating hot water and carried to a separation cell maintained at a temperature of about 185°F. In the separation cell, sand settles to the bottom as tailings and oil rises to the top in the form of a froth. An aqueous middlings layer comprising clay and silt and some oil is formed between these layers. This basic process may be combined with a scavenger step for further treatment of the middlings layer obtained from the primary separation step to recover an additional amount of oil therefrom.

The middlings layer either as it is recovered from the primary process or as it is recovered after the scavenger step comprises water, clay and oil. The oil content is of course, higher in middlings which have not undergone secondary scavenger steps.

Hereinafter in this specification, the term "effluent discharge" will be used to describe any aqueous stream associated with the hot water extraction of bitumen from tar sands which stream is not the primary product of the process. These streams include unprocessed middlings material, middlings material of depleted oil content which has undergone final treatment and which comprises clay dispersed in water, the sand tailings layer also containing some clay and bitumen and other discharged water-containing fractions, which are recovered as waste products. The effluent discharge is removed from the process plant as a slurry of about 35 to 55, typically 45 percent, solids by weight. Included in the slurry is sand, silt, clay and small quantities of bitumen. In this specification, sand is siliceous material which will not pass a 325 mesh screen. Silt will pass 325 mesh but is larger than 2 microns. Clay is material smaller than 2 microns including some siliceous material of that size. Included in the slurry is sand, silt, clay and small quantities of bitumen ranging from about 0.5 to 2.0 weight percent of the total discharge.

Because the effluent contains oil emulsions, finely dispersed clay with poor settling characteristics and other contaminants, water pollution considerations prohibit discarding the effluent into rivers, lakes or other natural bodies of water. The disposal of the effluent discharge has therefore presented a problem. Currently, effluent discharge is stored in evaporation ponds which involve large space requirements and the construction of expensive enclosure dikes. A portion of the water in the effluent discharge is recycled back into the hot water extraction process as an economic measure to conserve both heat and water. However, experience has shown that the dispersed silt and clay content of the recycled water can reduce primary froth yield by increasing the viscosity of the middlings layer and retarding the upward settling of oil flecks. When this occurs, the smaller oil flecks and those that are most heavily laden with mineral matter stay suspended in the water of the separation cell and are removed from the cell with the middlings layer.

Effluent discharge from the hot water process for extracting bitumen from tar sands as generally disclosed contains a substantial amount of mineral matter, much of which is colloidally dispersed in the effluent discharge and therefore does not settle very readily when stored in the retention pond. The lower layer of the retention pond can contain up to 50 percent dispersed mineral matter substantially of clay and silt as well as up to 5 percent bitumen. This part of the pond water is normally referred to as sludge. Sludge is not suitable for recycling to the hot water extraction process for the reason that its addition into the separation cell or the scavenger cell at the normal inlet means would raise the mineral content of the middlings of the cell to the extent that recovery of bitumen would be substantially reduced. Generally, the settling which does take place in the pond provides a body of water in which the concentration of mineral matter increases substantially from the surface of the pond to the bottom thereof. As a typical example a pond of effluent discharge having a surface area of about 1000 acres and an average depth of 40 feet can be characterized somewhat as follows:

a. From the surface of the pond to a depth of 15 feet the mineral concentration which is primarily clay is found to be about 0.5 to 5.0 weight percent. This pond water can normally be recycled to a hot water extraction process without interfering with the extraction of bitumen from tar sands.

b. The layer of water in the pond between 15 and 25 feet from the surface contains between 6 and 15 percent mineral matter. This water if recycled to the separation cell feed with fresh tar sands would increase the mineral content of the middlings portion of the cell to the point that little bitumen would be recovered.

c. Finally, the section of the pond between 25 feet and the bottom of the pond contains 16 to 50 percent mineral matter and is normally referred to as sludge.

The present invention provides a method for recovering bitumen from any aqueous stream containing the same. More specifically, the present invention comprises a method whereby recovery of bitumen from any of the aqueous bitumen-containing streams associated with a hot water process such as that noted above can be improved. In one aspect the present invention can be considered an improvement in the hot water process for extracting bitumen from tar sands.

DESCRIPTION OF THE INVENTION

The present invention is a method for recovering bitumen from an aqueous stream containing the same.

Specifically, the present invention is a method for improved recovery of bitumen from aqueous streams associated with the hot water process for extracting bitumen from tar sands.

It has been discovered that by aerating an aqueous stream containing bitumen at a pressure above atmospheric, suddenly reducing the pressure on the mixture and settling the mixture at a pressure lower than the pressure at which the stream was aerated, improved recovery of bitumen is obtained.

More particularly it has been discovered that by aerating an aqueous stream of tar sands pulp at superatmospheric pressure or aerating an effluent discharge stream from a hot water process for extracting bitumen from tar sands at superatmospheric pressure and thereafter settling the aerated stream at a lower pressure, improved recovery of bitumen is realized.

In one mode of the present invention, it has been discovered that by aerating a mixture of bitumen, minerals and water, at a temperature in the range of 40° to 200°F. at a relatively high pressure, e.g., above atmospheric, and thereafter settling the mixture at a lower pressure, the recovery of bitumen froth from the stream is enhanced. It has been discovered that by aerating a tar sands pulp under pressure and thereafter settling the pulp in a hot water extraction vessel at a lower pressure, for example, atmospheric pressure, recovery of bitumen froth is improved when compared to settling a pulp without the relatively high pressure aeration step. Further, it has been discovered that the efficiency of the hot water extraction process can also be increased if the middlings stream normally found in the hot water extraction primary settling vessel is subject to relatively high pressure aeration and subsequently settled at a lower pressure. Also it has been discovered that treating bitumen-containing effluent discharge streams in this manner provides a means of recovering bitumen from those streams.

Specifically, the invention involves releasing the pressure on the aerated stream relatively quickly so that a froth is formed by bitumen and expanding dissolved air which forms bubbles and the rising air bubbles help float the bitumen particules. As one means of illustrating one mode of the method of the present invention, the drawing in the figure is provided. Referring to the drawing, bituminous tar sands are fed into a conditioning vessel 17 via line 2 where they first are mixed with water which is introduced via line 1 and stream introduced via line 4. The total water so introduced is a minor amount based on the weight of the tar sands processed and generally is in the range of 10 to 45 percent by weight of the conditioning vessel mixture. Enough steam is introduced to raise the temperature in the conditioning drum to within the range of 100° to 200°F. and preferably in the range of 130° to 180°F. An alkaline reagent can also be added to the conditioning vessel usually in the amount of about 0.1 to 3.0 pounds per ton of tar sands at this time. The amount of such alkaline reagent is preferably regulated to maintain the pH of the middlings layer in separation zone 14 to a range of 7.5 to 9.0 with the best results being obtained at a pH value in the range of 8.0 to 8.5. The amount of alkaline reagent that needs to be added to maintain the desired pH value may vary from time to time as the composition of the tar sands varies. The preferred alkaline reagents are caustic soda, sodium carbonate, or sodium silicate. Also, recycle water obtained from separation zone 14 via line 12 can be transferred into the conditioning vessel via line 3 as a part of the water provided to prepare the tar sands pulp therein.

Mulling of tar sands produces a pulp which then passes from conditioning vessel 17 as indicated by 5 through screen 7 which is aided by additional water added thereto via line 6. Screen 7 aids in removal of debris such as rocks and oversized lumps from the tar sands, which removal is indicated by line 8. The tar sands pulp is thereafter transferred to pressure aeration zone 9 via line 28. Air can be added to the tar sands pulp in line 28 via line 10. The air is pumped into the stream at a pressure above atmospheric. Also, additional recycle water from zone 14 can be added to the tar sands pulp via lines 12 and 11 respectively.

Pressure aeration zone 9 can be a vessel such as a tank or a column or can be in the form of piping which is sufficient in length to provide the required residence time to accomplish the entrainment of air in the pulp as required in the process of the present invention. The residence time of the pulp in the pressure zone can range from about 0.5 to 5 minutes with about 1 to 2 minutes being the preferred residence time, but as long as air entrainment is achieved the actual residence time is immaterial. Pressure maintained within the pressure zone will normally be in the range of 10 to 100 psig with a preferable range being 25 to 75 psig and with the most preferred range being 45 to 55 psig. Air can be added to the tar sand pulp-water mixture to saturate the liquid with the air in line 28. It is desirable not to add excess air at this step to avoid turbulence later in the separation zone.

A preferred means of adding air to this zone comprises introducing air through line 10 into the tar sands pulp in line 28. Dissolving air in the aqueous pulp under a high pressure in zone 9 permits formation of small bubbles within the pulp mixture when the pressure is subsequently reduced. The mixture is passed through a pressure regulating valve not shown from pressure zone 9 via line 13 into settling vessel 14. The pressure maintained in separation zone 14 can normally be within the range of atmospheric pressure up to a few pounds per square inch below the pressure obtained in pressure zone 9. In settling zone 14, air bubbles form as a result of the reduced pressure as compared to pressure zone 9 and thereby effect upward movement of bitumen in the separation vessel to provide improved flotation of bitumen. Formation of air bubbles is particularly enhanced when the pressurized aerated tar sands-water mixture is suddenly released into the lower pressure settling zone thereby providing the same effect as seen when the cap of a pressurized container of a carbonated beverage is released, often referred to as the "pop bottle" effect.

Settling cell 14 is a relatively quiescent separation zone wherein the diluted tar sand pulp from pressure vessel 9 settles into an upper froth layer, a lower sand tailings layer, and an aqueous middlings layer containing bitumen, mineral matter, and water. In the process the lower sand tailings layer is removed via line 15 and can be discarded. The upper bitumen froth product layer is removed via line 16 and transferred to line 27 where it is combined with additional froth product from line 24 as hereinafter defined. The middlings material of separation zone 14 is transferred in part via line 18 into pressure zone 21 or can bypass pressure zone 21 directly into settling zone 23 by means not shown. Also, middlings material from separation zone 14 can be recycled to either conditioning vessel 17 via lines 12 and 3 or to the feed of pressure zone 9 via lines 12 and 11.

In a process where a second pressure zone is utilized to improve the recovery of bitumen from middlings material, air is added to the feed material in line 18 via line 19 just prior to passing the material into pressure zone 21. Also, a recycle stream can be added to the middlings feed material from zone 14 in line 18 via line 20 which receives the tailings of settling zone 23 via line 25. The feed material into zone 21 is permitted sufficient time to entrain the air added in the manner similar or equivalent to the process accomplished in pressure zone 9. The aerated middlings material is thereafter transferred via line 22 into settling zone 23 which is maintained at a pressure lower than that of pressure zone 21.

As a result of the lower pressure in settling zone 23, the entrained air forms bubbles thereby enhancing the flotation of bitumen from the stream to provide an upper bitumen froth layer and a lower tailings layer comprised primarily of water, mineral matter, and minor amounts of bitumen. The secondary froth layer recovered from zone 23 can be transferred into line 27 via line 24 wherein it can be admixed with the primary froth recovered from extraction zone 14 via line 16. The total froth product from the processes is thereafter recovered via line 27 for further processing.

As previously stated, the tailings layer from separation zone 23 is withdrawn via line 25 and can be discarded in part or as a whole via line 26 or can be recycled via line 20 to line 18 wherein it is admixed with the middlings material withdrawn from separation zone 14. Pressure zone 21 can be a vessel or piping which is sufficient in length and volume to provide the required residence time to accomplish entrainment of air in the middlings material being treated. Residence time of the aerated middlings in the pressure zone can range from 0.5 to 5 minutes with about 1 to 2 minutes being preferred. Pressure maintained within the pressure zone 21 should be within the range of 10 to 100 psig with a preferrable range of 25 to 75 psig and most preferred range being about 45 to 55 psig. As noted before, however, these pressures and times are not critical.

In settling cell 23, the most preferred pressure is atmospheric pressure. However, any pressure lower than the pressure in pressure zone 21 will accomplish the enhanced flotation of bitumen from the aerated middlings material being treated therein.

Where the pressure treatment of the middlings material recovered from zone 14 is not desired, the middlings can be transferred to an atmospheric air scavenger zone as disclosed in the Fear et al. patent noted above. A secondary froth recovered by the Fear et al. process can be combined with the primary froth recovered from zone 14 and transferred into line 27 via line 24 to be recovered as froth product.

The improved process of the present invention, utilizing dissolved air to aid in the flotation of bitumen from tar sands, provides distinct advantages over prior art methods. For example, one method in the prior art proposes the use of hydrocarbons as a flotation medium. The use of hydrocarbons as a flotation medium inherently requires expensive explosion-proof equipment. The process of the present invention does not require explosion-proof equipment thereby adding substantial capital savings in equipment investment. Also, the process of the present invention provides that hot water extraction of tar sands can be operated at a lower temperature than the hot water extraction techniques without the present improvement. Thus, a savings in fuel necessary to maintain a higher temperature in hot water extraction is realized. Also, by utilization of lower temperatures, lower grade ores, that is, tar sands having a lower bitumen content, are usable as feed material in a hot water extraction process.

The process of the present invention will operate satisfactorily at a temperature in the range of 100° to 200°F. and preferably in the range of 120° to 180°F. Elevated temperatures are often required for the initial bitumen separation from mineral in the conditioning drum. Air solubility in water decreases with increasing temperature and hence reduces the volume of flotation gas available. Fluid density and viscosity are similarly reduced which tends to aid bitumen flotation. This process by its ability to operate at lower temperatures than presently used commercial hot water extraction processes can maintain sufficient dissolved air in the tar sands-water mixture to achieve a high rate of flotation in extraction and settling zones. Also, it has been discovered that a lower quantity of hot water is required by the process of the present invention as compared to commercial processes now in use for similar overall bitumen recovered particularly when processing low-grade tar sand. This end is accomplished because of the fact that bitumen flotation is aided by dissolved gas and, therefore, is less sensitive to the system viscosity and density. Therefore, a higher viscosities achieved by using less fresh water can be tolerated to produce similar recoveries.

As a means of further defining the improvement realized by use of this mode of the present invention, the following examples are herewith given.

EXAMPLE I

In the hot water extraction process practiced as disclosed in the Fear et al. Canadian patent noted above, tar sands containing approximately 9 percent bitumen are fed into a hot water extraction process at the rate of 2,000 tons per hour. A total of approximatey 1,000 tone per hour of hot water and 60 tons per hour of steam are added to the tar sands in the conditioning stage. In the primary settling step of this process, approximately 117 tons per hour of froth are recovered. In the secondary froth extraction process known as the air scavenger zone, as defined in the Fear et al. patent, approximately 38 tons per hour of froth are recovered providing a total of 155 tons per hour of bitumen recovered. An evaluation of this process points out that the primary separation vessel provides about 65 percent recovery of the bitumen in the feed material and the secondary bitumen recovery phase provides an additional 21 percent recovery with the total recovery overall being approximately 86 percent of the bitumen fed to the process.

EXAMPLE II

As a means of comparison, substantially identical tar sands as disclosed in example I above are fed into a hot water extraction process as in example I at the rate of 2,000 tons per hour. A total of approximately 1,000 tons per hour of hot water and 60 tons per hour of steam are added to the tar sands in the conditioning stage. The tar sands-water mixture is thereafter aerated at a pressure of 45 psig for about 2 minutes while being transferred through a pipe to a primary settling zone maintained at atmospheric pressure. The aerated mixture prior to entering the settling zone passes through a constriction in the line to effect a sudden release of pressure as the mixture enters the settling zone. Approximately 137 tons per hour of bitumen froth are recovered in the primary settling zone. The middlings material from the settling zone is transferred to an air scavenger zone where an additional 25 tons per hour of bitumen froth is recovered to provide a total recovery of 162 tons per hour of bitumen from the process. Thus by this process 90 percent of the bitumen in the tar sands fed into the process is recovered, which represents a substantial improvement over the prior art as illustrated in example I.

Thus by the utilization of the process of the present invention having the improvements disclosed therein over the prior art hot water extraction methods, it is shown that an improvement in the recovery of bitumen from tar sands is accomplished. Thus, this mode of the process of the present invention provides an improved hot water extraction process for recovering bitumen from tar sands, one embodiment thereof comprising:

a. forming a mixture of tar sands, water, steam, and an alkaline reagent at a temperature in the range of 100° to 200°F and at atmospheric pressure;

b. subjecting said mixture to a pressure in the range of 10 to 100 psig while concurrently adding air to said mixture;

c. transferring said aerated mixture to a settling zone maintained at a pressure lower than the pressure maintained during the addition of air to the mixture;

d. settling the mixture in said settling zone to form an upper bitumen froth layer, a lower sand tailings layer, and a middlings layer containing bitumen, clay, water, and some silt and e. recovering said froth layer.

In another mode of the process of the present invention and referring again to the drawing, tar sands are conditioned in conditioning drum 17 of the FIGURE as hereinabove described. The conditioned sands are transferred to screen 7 via line 5 and thereafter to zone 9 which is a sump. Additional recycled middlings can be added to the tar sands pulp in sump 9 via 11 and 12 respectively. The diluted pulp is thereafter transferred from sump 9 to settling zone 14 via line 13.

Settling cell 14 is a relatively quiescent separation zone wherein the diluted tar sand pump settles into an upper froth layer, a lower sand tailings layer, and an aqueous middlings layer containing bitumen, clay, silt, and water. In the process, the lower sand tailings layer is removed via line 15 and can be discarded. The upper bitumen froth product layer is removed via line 16 and transferred to line 27 where it is combined with additional froth product from line 24 as hereinafter defined. The middlings material of separation zone 14 is transferred at least in part via line 18 into pressure zone 21. Also, middlings material from separation zone 14 can be recycled to either conditioning vessel 17 via lines 12 and 3 or to sump 9 via lines 12 and 11 respectively, as hereinafter disclosed.

Air is added to the middlings material in line 18 via line 19 just prior to passing the material into pressure zone 21. Also, a recycle stream can be added to the middlings feed material from zone 14 in line 18 via line 20 which receives the tailings of settling zone 23 via line 25. The feed material into zone 21 is permitted sufficient time to entrain the air added. The aerated middlings material is thereafter transferred via line 22 into settling zone 23 which is maintained at a pressure lower than that of pressure zone 21.

As a result of the lower pressure in settling zone 23, the entrained air forms bubbles thereby enhancing the flotation of bitumen from the stream to provide an upper bitumen froth layer and a lower tailings layer comprised primarily of water, mineral matter, and minor amounts of bitumen. The secondary layer recovered from zone 23 can be transferred into line 27 via line 24 wherein it can be admixed with the primary froth recovered from extraction zone 14 via line 16. The total froth product from the process is thereafter recovered via line 27 for further processing.

As previously stated, the tailings layer from separation zone 23 is withdrawn via line 25 and can be discarded in part or as a whole via line 26 or can be recycled via line 20 to line 18 wherein it is admixed with the middlings material withdrawn from separation zone 14. Pressure zone 21 can be a vessel or piping which is sufficient in length and volume to provide the required residence time to accomplish entrainment of air in the middlings material being treated. Residence time of the aerated middlings in the pressure zone can range from 0.5 to 5 minutes with about 1 to 2 minutes being preferred. However, a residence time which provides some measure of air entrainment is all that is required. Pressure maintained within the pressure zone 21 should be within the range of 10 to 100 psig with a preferable range of 25 to 75 psig and most preferred range being about 45 to 55 psig.

In settling cell 23, the most preferred pressure is atmospheric pressure. However, any pressure lower than the pressure in pressure zone 21 will accomplish the enhanced flotation of bitumen from the aerated middlings material being treated therein.

In another aspect of the present invention, bitumen can be recovered from effluent discharge associated with the aqueous extraction of bitumen from tar sands. Specifically, this invention also provides a method for recovering bitumen from bitumen containing sludge formed in a retention pond used to store effluent discharge recovered from the hot water extraction of bitumen from tar sands. This invention particularly provides a means for the recovery of additional bitumen from aqueous streams associated with the hot water extraction procedure for recovering bitumen from tar sands.

This mode of the present invention in essence comprises an improvement on the method of recovering bitumen from tar sands using hot water extraction techniques. Specifically, the present method encompasses adding air to the sludge layer from a retention pond containing bitumen in an air pressure zone. The sludge layer is aerated at superatmospheric pressure to aerate bitumen in the sludge. Thereafter the aerated sludge is transferred from the air pressure zone to a settling zone at a lower pressure. The aerated sludge is subsequently settled in the settling zone. In the settling zone, the aerated bitumen froth rises to the surface of the zone while mineral and water form the lower layer in the settling zone. The froth product is then recovered from the surface of the settling zone and the lower layer of mineral matter and water can be recycled to th air pressure zone to provide for additional recovery of bitumen or can be discarded. The lower layer of the zone is partially depleted of bitumen but can still contain sufficient quantities of bitumen to warrant at least a part of it being recycled to the air pressure zone.

Thus by this method of the present invention, bitumen previously not recovered by the hot water extraction of tar sands and which is found in the sludge layer of a retention pond associated with the hot water extraction of tar sands is recovered thereby providing an improvement in the process of extracting bitumen from tar sands.

Essentially, this aspect of the method of the present invention comprises a process for recovering bitumen from a bitumen containing effluent discharge recovered from a hot water process for extraction of bitumen from tar sands comprising;

a. mixing effluent discharge containing some bitumen with air at a pressure greater than atmospheric;

b. settling the mixture in a settling zone at a pressure lower than that of step (a) to provide an upper bitumen froth layer and a lower tailings layer and c. recovering the upper bitumen froth layer.

The method of the present invention for recovering bitumen from effluent retained in the settling pond is operable at any temperature in the range of 40° to 200°F. and pressures from about 10 to 1,000 psig. It has also been discovered that the addition of sodium silicate can improve bitumen recovery in the method of this invention and particularly at the higher temperatures the addition of sodium silicate will improve the froth quality.

The feed material suitable for use in the process of the present invention is generally the effluent discharge from the hot water extraction process which is stored in a retention pond. As a practical matter the bitumen content of the water stored in the retention pond is higher in the sludge layer of the pond. Thus the sludge layer of the retention pond is most attractive for processing in accordance with the method of the present invention.

The sludge layer as herein defined can contain 5 to 50 percent mineral and 0.5 to 25 percent by weight bitumen. Also, in some instances this sludge layer can contain 0.2 to 5.0 weight percent light hydrocarbon which can be present as a result of addition thereof as found in one method of hot water extraction.

In the instances where the sludge layer contains lighter hydrocarbons, a slightly longer retention time provides a more efficient recovery of bitumen from the sludge layer. In general the recycle of the tailings from the settling zone can be adjusted to the ratio of 1 volume of recycle tailings to 1 volume of fresh feed fed into the air treating zone. The bitumen froth recovered from the settling zone is normally combined with a froth recovered from hot water extraction process. The froth is thereafter processed further by means not shown to provide a synthetic crude oil suitable for use in general commercial trade. This synthetic crude oil can be provided by hydrovisbreaking of the bitumen froth or by delayed coking or other means well known in a general petroleum processing industry. The froth can also be further refined by diluting with a lower boiling hydrocarbon and can thereafter be centrifuged to remove additional water and mineral matter prior to hydrovisbreaking or coking steps.

It is essential in the practice of the process of the present invention that the drop in pressure on the aerated stream being treated is sudden so that air bubbles are formed in the stream. The change in pressure should be at least 10 psig.

The sudden pressure drop between the aeration step and the settling step of the present invention can be accomplished in several ways. For example, in a batch process the aeration and settling can be accomplished in a single vessel such as an autoclave. The bitumen containing stream is transferred into the autoclave which is thereafter sealed and pressurized to the desired pressure. Air is thereafter bubbled into the stream. Subsequently, the pressure in the autoclave is released causing a sudden pressure drop, after which the stream is permitted to settle and bitumen which has floated to the surface is recovered.

In the more preferred embodiment the stream to be treated is continuously pumped from its source to a settling vessel. This transfer and aeration can be accomplished through a pressurized pipe or tank. The settling vessel is maintained at atmospheric pressure. The inlet means of the settling vessel which communicates with the feed pipe is constricted to provide a sudden pressure drop on the stream after it passes through the constriction into the settling vessel. This sudden pressure drop aids in the formation of air bubbles which inturn improve the flotation of bitumen in the stream.

The pressure drop for the present invention is at least 10 psig and preferably in the range of 10 to 200 psig. The process is operable at pressures in the range of 10 to 1,000 psig with 10 to 200 psig being preferred.

The invention claimed is:

1. In the hot water process for recovering bitumen from tar sands wherein an aqueous effluent from the hot water separation step passes to a retention pond and a sludge layer separates therefrom, the steps for recovering bitumen from the sludge which comprises;

a. forming an intimate mixture of the sludge and air at a relatively high pressure;
b. passing the mixture through a constriction into a zone maintained at a reduced pressure to form a froth and
c. settling the mixture at reduced pressure to separate a bitumen froth product.

2. An improved process for recovering bitumen from tar sands comprising:

a. forming a mixture of tar sands and water;
b. aerating said mixture in an aeration zone at a pressure above atomspheric;
c. suddenly reducing the pressure on said mixture;
d. settling said aerated mixture at said reduced pressure to provide a recoverable upper bitumen froth layer, a sand tailings layer, and a middlings layer containing bitumen, clay, water, and some silt; and
e. recovering said froth layer.

3. A process according to claim 2 wherein air is added to the mixture of step (a) while the mixture is maintained at a pressure in the range of 10 to 100 psig.

4. A process according to claim 2 wherein the sudden reduction of pressure of step (c) is accomplished by passing the aerated mixture of step (b) through a constriction into settling zone maintained at a lower pressure than that of the aerated zone.

5. A process according to claim 4 wherein air is added to the mixture of step (a) while the mixture is maintained at a pressure in the range of 10 to 100 psig.

6. A process according to claim 2 wherein the reduction of pressure in step (c) is at least 10 psig.

7. A process according to claim 5 wherein the reduction of pressure in step (c) is at least 10 psig.

8. An improved hot water extraction process for recovering bitumen from tar sands comprising:

a. forming a mixture of tar sands, water, steam, and an alkaline reagent at a temperature in the range of 100° to 200°F. and at atmospheric pressure;
b. subjecting said mixture to a pressure in the range of 10 to 100 psig while concurrently adding air to said mixture;
c. transferring said aerated mixture through a constriction to a settling zone maintained at a pressure lower than the pressure maintained during the addition of air to the mixture and thereby effecting a sudden reduction in pressure on the mixture;
d. settling the mixture in said settling zone to form an upper bitumen froth layer, a lower sand tailings layer, and a middlings layer containing bitumen, clay, water, and some silt; and
e. recovering said froth layer.

9. A process according to claim 8 wherein the pressure maintained in step (d) is at least 10 psig below the pressure maintained in step (b).

10. A process according to claim 8 wherein the settling zone of step (c) is maintained at a pressure in the range of atmospheric to 10 psig and the temperature is maintained in the range of 100° to 200°F.

11. A process according to claim 8 wherein at least a part of the middlings layer of step (d) is transferred to an air scavenger zone wherein additional bitumen is recovered therefrom.

12. A process according to claim 8 wherein at least a part of the middlings layer of step (d) is (i) aerated in an aeration zone at a relatively high pressure; (ii) subsequently suddenly reducing the pressure to a value below the pressure at which air was added to provide an upper bitumen froth; and (iii) recovering said additional bitumen froth.

13. A process according to claim 12 wherein the pressure of step (i) is between 10 and 100 psig and the pressure maintained in step (ii) is in the range of about atmospheric to about 10 psig below the pressure maintained in step (i).

14. A process according to claim 12 wherein step (ii) is carried out by passing the middlings-air mixture through a constriction to effect a sudden reduction of pressure.

15. An improved process for recovering bitumen from tar sands comprising:

a. forming a mixture of tar sands and water;
b. settling the mixture in a first settling zone to provide an upper bitumen froth layer, a sand tailings layer, and a middlings layer containing bitumen, water, clay, and silt;
c. recovering said bitumen froth layer;
d. withdrawing at least a part of the middlings layer and admixing air therewith at a relatively high pressure in an aeration zone;
e. suddenly reducing the pressure on said air middlings mixture;
f. settling said aerated mixture at said reduced pressure to provide second froth layer and a lower tailings layer; and
g. recovering said second froth layer.

16. A process according to claim 15 wherein step (e) is carried out by passing said mixture through a constriction from said aeration zone to a settling zone to effect a sudden reduction of pressure.

17. A process according to claim 15 wherein the pressure maintained in step (f) is at least 10 psig below the pressure maintained in step (d).

18. A process according to claim 15 wherein the pressure maintained in step (d) is in the range of 10 to 100 psig.

19. A process according to claim 18 wherein at least a part of the lower tailings layer of step (f) is withdrawn and added to the mixture of step (d).

20. A process according to claim 18 wherein step (e) is carried out by passing said mixture through a constriction from said aeration zone to a settling zone to effect a sudden reduction of pressure.

* * * * *